United States Patent [19]

Husson

[11] 4,120,352

[45] Oct. 17, 1978

[54] DEVICE FOR CONNECTING EXCHANGER TUBES TO PERFORATED PLATES

[75] Inventor: Jean Husson, Louviers, France

[73] Assignee: S.E.R.A. Husson Societe d'Etudes et Realisations Aerodynamiques, Paris, France

[21] Appl. No.: 747,737

[22] Filed: Dec. 6, 1976

[30] Foreign Application Priority Data

Dec. 5, 1975 [FR] France ..... 75 37533

[51] Int. Cl.[2] ..... F28F 9/06

[52] U.S. Cl. ..... 165/173; 29/157.4; 165/82; 165/178; 285/DIG. 19

[58] Field of Search ..... 165/178, 82, 173, 149; 29/157.4; 285/162, 158, 189, DIG. 19; 16/2

[56] References Cited

U.S. PATENT DOCUMENTS

| | | | |
|---|---|---|---|
| 1,235,057 | 7/1917 | Roberson | 165/149 |
| 1,271,135 | 7/1918 | Coltrin | 165/149 |
| 2,013,660 | 9/1935 | Lauer | 285/158 |
| 2,394,402 | 2/1946 | Pennella | 165/178 |
| 2,816,739 | 12/1957 | Stoehr | 165/178 |
| 2,839,316 | 6/1958 | Kasper | 285/158 |
| 3,391,732 | 7/1968 | Murray | 285/158 |
| 3,559,730 | 2/1971 | Denjean | 165/178 |
| 3,749,161 | 7/1973 | Hibbeler | 29/157.4 |
| 3,953,555 | 4/1976 | Gley | 285/162 |

FOREIGN PATENT DOCUMENTS

| | | | |
|---|---|---|---|
| 1,205,564 | 11/1965 | Fed. Rep. of Germany | 165/178 |
| 1,275,943 | 10/1961 | France. | |
| 2,209,088 | 6/1974 | France. | |
| 621,694 | 6/1961 | Italy | 165/178 |
| 535,415 | 5/1973 | Switzerland | 165/82 |
| 902,508 | 8/1962 | United Kingdom | 165/178 |

*Primary Examiner*—Charles J. Myhre
*Assistant Examiner*—Sheldon Richter
*Attorney, Agent, or Firm*—Peter K. Kontler

[57] ABSTRACT

A device for sealingly connecting the end of a glass tube to the edge of a hole in a rigid plate including a resilient ring with a axial half-section in the shape of a flattened Z, said ring being made up of two cylindrical sleeves which partly enclose one another and are axially offset in relation to one another.

3 Claims, 3 Drawing Figures

DEVICE FOR CONNECTING EXCHANGER TUBES TO PERFORATED PLATES

BACKGROUND AND SUMMARY OF THE INVENTION

The invention relates to improvements in devices for connecting in tight, sealing relationship to two rigid parallel perforated plates with the ends of tubes of glass or a similar material forming part of a bundle of parallel vertical or inclined tubes making up a heat exchanger.

The invention relates more particularly to devices which comprise a resilient ring for connecting each tube end with the edge of a hole in a plate.

According to the invention, if *d* denotes the inside diameter of the tube, D its outside diameter and *t* the diameter of the hole, the diameter *t* is equal or substantially equal to D and the ring has in axial half-section the general shape of a flattened Z, such ring being made up of two cylindrical sleeves which partly enclose one another and are offset axially in relation to one another, the first sleeve having an inside diameter *d* and an outside diameter *t* and being adapted to penetrate joiningly into the hole and to axially abut the tube end, while the second sleeve has an inside diameter D and is adapted to enclose joiningly such tube end and to rest axially against the edge of the hole.

An assembly of this kind eliminates the risk that, if the lower connecting ring of a tube to the lower plate is damaged or destroyed, such tube drops through the hole facing such plate, which risk appeared with the prior art assemblies, causing many inconveniences: with the assembly of the invention, even if only small pieces of the lower ring remain in place, they are enough to prevent the free passage of the tube through the hole, the radial clearance required for such passage being insufficient.

In preferred embodiments one and/or the other of the following arrangements are used: the two sleeves are moulded in a single unit; the two sleeves making up the same ring are inserted in one another and made of different materials, the first sleeve being inter alia formed by an asbestos jacket; the second sleeves of the rings connecting adjacent tube ends to the same plate bear laterally against one another; the two plates are strutted by rigid bars, preferably four bars, with the interposition of resilient washers between the bars and at least one of the two plates.

Apart from these main arrangements, the invention comprises certain other arrangements which are preferably used simultaneously and will be more explicitly described hereinafter.

DESCRIPTION OF THE PREFERRED EMBODIMENTS

Figure 2:
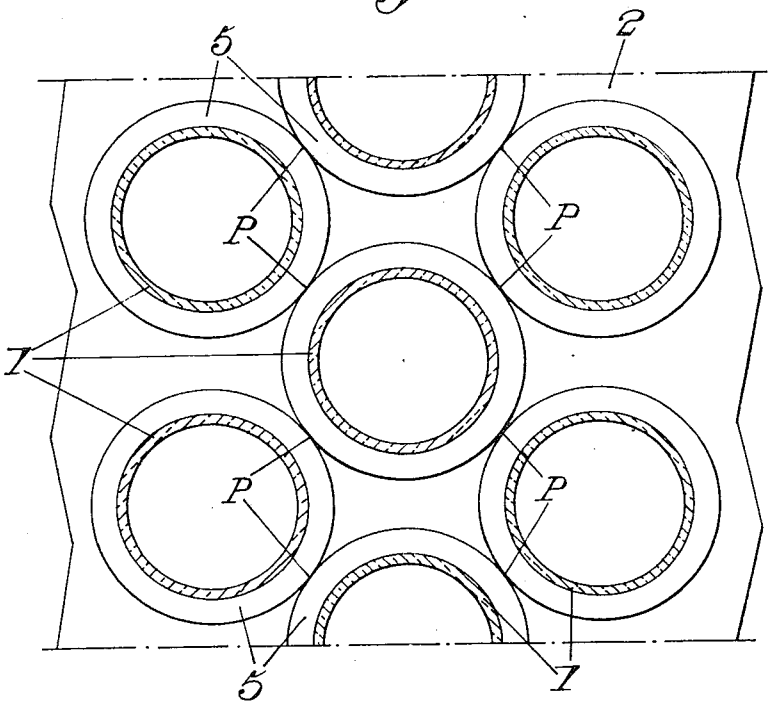
FIG. 2 shows, in cross-section along the line II-II in FIG. 1, the distribution of the various rings for assembling a plurality of parallel heat exchanger tubes on the same perforated plate according to the invention.
Figure 1:
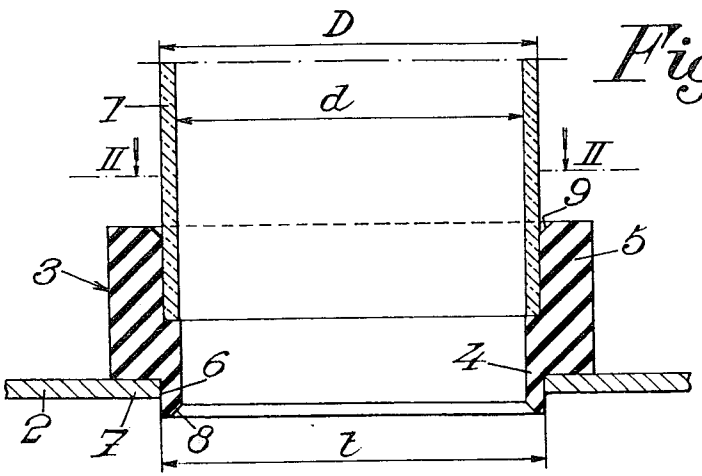
FIG. 1 shows in axial section the connection of a tube end to a perforated plate by means of a resilient ring according to the invention.

The tubes 1 of the exchanger are made of glass, inter alia of borosilicate glass, such as that known as Pyrex or of any other material having equivalent features as regards smooth surface and resistance to corrosion.

The tubes have an outside diameter D, generally between 20 and 40 mm (for instance, 31 mm) and an inside diameter *d* less than the diameter D by a value generally close to 2 mm, this corresponding to a tube thickness of the order of 1 millimeter.

Advantageously the tubes have a length of the order of 1 to 2 meters.

They are orientated vertically or inclined at an angle to the vertical.

Each of their ends is mounted on a rigid plate 2 formed with circular holes 6 of diameter *t* and made inter alia of stainless steel or a plastic material resistant to temperature and corrosion.

The diameter *t* is substantially equal to D, in the sense that such equality is within the range of about 1 millimeter for the numerical values set forth hereinbefore.

Each end of the tube 1 is mounted on the plate 2 via a ring 3 made of a resilient material, inter alia an elastomer (neoprene, silicone), or polytetrafluoroethylene, its Shore hardness being preferably of the order of 70.

In axial half-section the ring 3 has the general shape of a flattened Z and is made up of two cylindrical sleeves 4, 5 partly enclosing one another and axially offset in relation to one another, i.e.: a first inner sleeve 4 of inside diameter *d* and outside diameter *t*, whose axial ends are adapted to penetrate joiningly into the hole 6 in the plate 2 and to axially abut the end of the tube 1 respectively; and a second outer tube 5 of inside diameter D whose axial ends are adapted to enclose joiningly such tube end and to rest axially against the edge 7 of the hole 6 respectively.

Preferably, the external dimension *t* of the first sleeve 4 and the internal dimension D of the second sleeve 5 are slightly too large and slightly too small respectively, so as to create a radial clamping of the ring against the edge 7 of the hole 6 and the end of the tube 1 respectively, thus ensuring satisfactory tightness of the connection between the tube and plate.

Since moreover in operation the tubes are heated by the fluid passing through them and/or splashing on them externally, they undergo axial and radial thermal expansion which reinforces the clamping and sealing effect by resiliently compressing the ring 3.

The two sleeves can be moulded in a unitary block, as in the embodiment illustrated, but in some cases it may be advantageous to give special temperature resistance to the inner sleeve 4, which is the only one directly in contact with the fluid flowing inside the tube.

In such cases the two sleeves can be made separately and then inserted in one another, inter alia by providing a small collar on one of the two sleeves adapted to cooperate with an annular groove in the other sleeve; for instance, the inner sleeve 4 might take the form of an asbestos jacket connected by mechanical means or adhesion to the sleeve 5.

Only the inner sleeve, comprised by a monobloc ring, might also be given a special treatment.

Chamfers 8, 9 are advantageously provided on the free end of the inner face of the first sleeve 4, so as to facilitate the flow of the fluid entering or leaving the tube, and at the free end of the inner face of the second sleeve 5, to facilitate the introduction of the end of the tube 1 into such sleeve.

As already stated, whether the diameters *t* and D are strictly equal or not, the result in practice is that the tube 1 cannot drop through the facing lower hole even if the ring 3 is more or less completely destroyed.

Moreover, the tube end does not penetrate into the hole in the plate and is therefore not retained laterally by the edge of such hole. To ensure such lateral retention, the radial thickness of the second sleeve 5 is reinforced: for the numerical values indicated hereinbefore, such thickness may reach 5 mm.

According to another advantageous improvement according to the invention, the holes in the plate 2 are so distributed that the adjacent sleeves 5 — i.e., corresponding to rings 3 mounted on holes adjacent such plate — bear laterally against one another along generatrices P (FIG. 2). The fact that the sleeves 5 bear laterally against one another in this manner prevents them from sagging, even under particularly difficult operating conditions.

In the most usual case the number of such lateral bearings P is 4 per sleeve, for sleeves corresponding to tubes not disposed on the periphery of the bundle.

Figure 3:
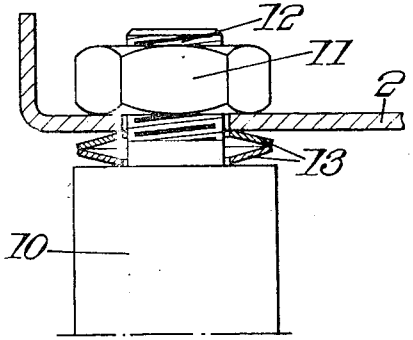
FIG. 3 is a side view of the assembly of a strutting bar of a tubular heat exchanger according to the invention with one of the perforated plates of the exchanger.

In the preferred embodiments, the tube bundle considered with its two rigid end plates forms an autonomous block, the two plates being strutted by metal bars 10 (FIG. 3), each bar end preferably being screwed to a plate by cooperation between a nut 11 and a screwthreaded tip 12 terminating such end.

If the bundle has a generally parallelepipedic shape, a shape which is particularly well adapted to modular assemblies, four barr are used which are disposed respectively along the four edges of the bundle and are parallel with the tubes.

In operation, the heated bars expand more than the tubes, since metal expands more than glass or a similar material. This is the reason why the second sleeves are advantageously given relatively considerable axially lengths, the second sleeves then forming guide jackets to enable at least one of the ends of each tube to move axially over a small length, for instance, of the order of 1 millimeter, in relation to the corresponding rings. The height by which each jacket projects beyond the sleeve 4 can thus be of the order of 8 mm for the numerical values considered hereinbefore.

Movements of this kind can be reduced or even eliminated, in an advantageous arrangement according to the invention, by interposing resiliently compressible washers 13 axially between the bars 10 and at least one of the plates 2. The resistance to compression of the washers is low enough to enable the expansion of the bars 10 to compress the washers rather than to make all the tubes 1 of the bundle slide in their respective jackets.

The invention is not limited to those embodiments which have been more particularly envisaged but, on the contrary, it covers all variants.

We claim:

1. In a device wherein n rings of resilient material connect in tight sealing relationship a bundle of n parallel tubes of inside diameter d and outside diameter D in a heat exchanger to the edges of n holes in a rigid plate, the improvement comprising the diameter t of the holes being substantially equal to D and the rings having in axial half-section the shape of a flattened Z and comprising a plurality of cylindrical sleeves party enclosing one another, each sleeve including a first sleeve of inside diameter d and outside diameter t whose ends are respectively sealingly received in a hole of the plate and in axial abutment with the end of a tube, and a second sleeve of inside diameter D whose ends are respectively in sealing contact with the exterior of a tube end and in abutment with the edge of a hole, the second sleeves of the rings bearing laterally against one another.

2. A device as set forth in claim 1 wherein the second sleeves of the rings bear laterally against one another at four points, except for those disposed at the periphery of the bundle of tubes

3. A device as set forth in claim 1 wherein said second sleeves are thicker and longer than said first sleeves.

* * * * *